US009903093B2

(12) United States Patent
Wan

(10) Patent No.: US 9,903,093 B2
(45) Date of Patent: Feb. 27, 2018

(54) INTEGRALLY CAST EXCAVATOR BUCKET AND MANUFACTURING METHOD THEREOF

(71) Applicant: Hubei Wanxin Precision Casting & Forging Inc, Yichang, Hubei (CN)

(72) Inventor: Jiwen Wan, Hubei (CN)

(73) Assignee: Hubei Wanxin Precision Casting & Forging Inc (CN)

( * ) Notice: Subject to any disclaimer, the term of this patent is extended or adjusted under 35 U.S.C. 154(b) by 0 days.

(21) Appl. No.: 15/224,621

(22) Filed: Jul. 31, 2016

(65) Prior Publication Data

US 2017/0037592 A1 Feb. 9, 2017

(30) Foreign Application Priority Data

Jun. 6, 2016 (CN) ..... 2016 1 0396628

(51) Int. Cl.

| | |
|---|---|
| ***E02F 3/40*** | (2006.01) |
| ***B22C 9/03*** | (2006.01) |
| ***B22D 18/06*** | (2006.01) |
| ***B22D 27/20*** | (2006.01) |
| ***C21D 9/00*** | (2006.01) |

(Continued)

(52) U.S. Cl.

CPC ..... *E02F 3/40* (2013.01); *B22C 9/03* (2013.01); *B22D 18/06* (2013.01); *B22D 27/20* (2013.01); *C21D 1/06* (2013.01); *C21D 1/56* (2013.01); *C21D 1/773* (2013.01); *C21D 6/004* (2013.01); *C21D 6/005* (2013.01); *C21D 6/008* (2013.01); *C21D 9/0068* (2013.01);

(Continued)

(58) Field of Classification Search

CPC ..... E02F 9/2833; E02F 9/2841; E02F 3/60; E02F 3/40; E02F 3/407; E02F 3/401; B22C 9/03; B22A 18/06; B22A 27/20; C21D 6/004; C21D 6/005; C21D 6/008; C21D 9/0068; C21D 1/56; C21D 1/06; C21D 1/773; C22C 38/02; C22C 38/04; C22C 38/44; C23C 8/02; C23C 8/32

USPC ..... 37/195, 398, 399, 400, 401, 444, 445; 414/718, 719, 722, 725–728

See application file for complete search history.

(56) References Cited

U.S. PATENT DOCUMENTS 1,594,508 A * 8/1926 Rorabeck ..... E02F 3/40 37/444

1,945,064 A * 1/1934 Murtaugh ..... E02F 3/40 37/444

(Continued)

*Primary Examiner* — Robert E Pezzuto

(57) ABSTRACT

The present invention provides an integrally cast excavator bucket and a manufacturing method thereof. The integrally cast excavator bucket comprises a lifting lug, a top plate, two side plates and a bottom plate connected with the two side plates. A method for manufacturing the integrally cast excavator bucket by adopting the cast steel comprises the following steps: putting cast steel components into a melting furnace, and carrying out modification treatment before furnace after melting is finished; manufacturing models and a template, coating, heating, vacuumizing, placing sandboxes, adding sand, molding, carrying out mold closing, casting, quenching, tempering and cooling to room temperature to finish casting of the excavator bucket. The integrally cast excavator bucket is formed by once casting from a low-alloy steel material by adopting a vacuum sealing technology, and is high in product strength, resistant to wear and corrosion, high in impact resistance and long in service life.

11 Claims, 2 Drawing Sheets

(51) Int. Cl.

| | |
|---|---|
| ***C21D 6/00*** | (2006.01) |
| ***C21D 1/56*** | (2006.01) |
| ***C21D 1/773*** | (2006.01) |
| ***C21D 1/06*** | (2006.01) |
| ***C23C 8/32*** | (2006.01) |
| ***C22C 38/44*** | (2006.01) |
| ***C22C 38/04*** | (2006.01) |
| ***C22C 38/02*** | (2006.01) |
| ***C22C 38/00*** | (2006.01) |
| ***C23C 8/02*** | (2006.01) |

(52) U.S. Cl.

CPC ..... *C22C 38/002* (2013.01); *C22C 38/02* (2013.01); *C22C 38/04* (2013.01); *C22C 38/44* (2013.01); *C23C 8/02* (2013.01); *C23C 8/32* (2013.01)

(56) References Cited

U.S. PATENT DOCUMENTS 2,926,800 A * 3/1960 Larsen ..... E02F 3/40 219/137 R
4,459,768 A * 7/1984 Albrecht ..... E02F 3/40 37/444
4,939,855 A * 7/1990 McCreary, Jr. ..... E02F 3/40 37/195
5,937,550 A * 8/1999 Emrich ..... E02F 9/2825 37/456
6,249,995 B1 * 6/2001 Bush ..... E02F 3/3604 37/442
D469,786 S * 2/2003 Miller ..... D15/24
6,834,449 B2 * 12/2004 Leslie ..... E02F 3/60 37/398

* cited by examiner

INTEGRALLY CAST EXCAVATOR BUCKET AND MANUFACTURING METHOD THEREOF

FIELD

The invention belongs to the field of engineering machinery, and in particular relates to an integrally cast excavator bucket and a manufacturing method thereof.

BACKGROUND

An excavator bucket is generally made from a cast iron material, and after used for a long time, the cast iron material is worn more seriously. The cast iron material needs to be replaced while being unable to play a protection role upon wear. When a high-content alloy steel material having higher hardness is used to manufacture an excavator bucket, the high-content alloy material is extremely easy to be snapped from tension owing to relatively poor comprehensive mechanical property and relatively large brittleness caused by relatively high hardness although having better wear resistance. Moreover, the existing excavator bucket is almost formed by adopting a welding technology, without heat treatment, thus resulting in low wear resistance, easy breakage at a welding point and short service life.

Rare earth elements are generally added to improve the wear resistance of steel, but the problems of difficulty in control and limited effects are present although the rare earth elements have a certain effect on the improvement of performances, and thus it is unlikely to achieve expected mechanical property indexes in practical production.

The performances, in particular strength and toughness of steel depend on its tissue structure. The finer the grain is, and the higher the strength and the toughness of steel are. For steel, a traditional method of forming a fine grain microstructure in which an optimized combination of strength and toughness is generated is to perform thermo-mechanical treatment. Furthermore, further quality improvement has been realized by using an advanced ladle refining technology for deoxidization and desulfurization and by comprehensively reducing the oxygen content and the sulfur content of steel. However, problems in steel are not always caused by inclusions. By virtue of the capability of inclusions which can serve as effective non-uniform nucleation sites of different types of transformation products, such as ferrite and austenite, it is available to utilize a catalysis effect of the inclusions in a solidification process and in a solid state on evolution of a microstructure.

An aqueous quenching agent has the features: the aqueous quenching agent has high cooling rate through the whole cooling process, the aqueous quenching agent can promote grains to be refined with regular crystal forms in a high-temperature cooling stage, and thus facilitates to improve the service performance of workpieces, however, in a low-temperature cooling stage, problems, such as cracking, quenching deformation, occurrence of soft spots of workpieces are easily caused by overhigh cooling rate; and moreover, the problems, such as poor anti-rust performance and cleaning capability are common to the aqueous quenching agent, oxide skin is easily produced, more quenching workpieces are carried, and thus the machining technology and the production efficiency are greatly affected.

SUMMARY

Based on the above, the invention provides an integrally cast excavator bucket and a manufacturing method thereof.

Upon research and analysis performed to materials and processes, the excavator bucket is integrally cast by adopting a wear-resistant alloy material, such that the production process is simplified, and the performances are stable with high consistency.

The technical solutions of the present inventions are as follows:

an integrally cast excavator bucket comprises a lifting lug, a top plate, two side plates and a bottom plate connected with the two side plates, wherein the lifting lug, the top plate, the two side plates and the bottom plate are of an integral structure.

A side toothed plate is provided on the side plate, and a lifting lug reinforcing rib is provided at a position where the lifting lug is connected with the top plate.

The side toothed plate is configured to protect bodies at the two side plates against wear as the bodies at the side plates are unlikely to weld after being worn, however, the side toothed plate can be replaced after being worn. The lifting lug reinforcing rib has the functions of reinforcing the lifting lug, improving the bearing force of the lifting lug and prolonging the service life of the excavator bucket.

A plurality of wear-resistant blocks and wear-resistant spheres are provided in an area, close to a front edge of the bucket, of the side plate, wherein the wear-resistant blocks are close to a position where the side plate is connected with the bottom plate; and two longitudinal ribs are provided at positions, close to the two side plates, of the bottom plate, and a plurality of transverse ribs are provided in the middle of the bottom plate.

The provided wear-resistant blocks and wear-resistant spheres may increase the friction and improve the wear resistance of the side plates; the transverse ribs and the longitudinal ribs are cooperatively provided on the bottom plate to increase the friction and improve the wear resistance of the bottom plate; and the longitudinal ribs provided at positions, close to the two side plates, of the bottom plate also have a protecting effect on the side plates, and meanwhile improve the operation convenience of the excavator bucket.

The integrally cast excavator bucket which is of an integral structure formed by vacuum integral casting as described in the method of the present invention comprises a lifting lug, a lifting lug reinforcing rib, a top plate, two side plates, a bottom plate, wear-resistant blocks, wear-resistant spheres, longitudinal ribs and transverse ribs.

Cast steel for casting the excavator bucket consists of the following components in percentage by weight: 0.1% to 0.6% of C, 0.2% to 0.6% of Si, 0.5% to 1.8% of Mn, 0.5% to 1.6% of Cr, 0.2% to 0.75% of Ni, 0.1% to 0.6% of Mo, less than or equal to 0.035% of P, less than or equal to 0.035% of S, and the balance of Fe.

Further preferably, the cast steel comprises the following components in percentage by weight: 0.25% of C, 0.3% of Si, 1.2% of Mn, 0.8% of Cr, 0.25% of Ni, 0.4% of Mo, less than or equal to 0.035% of P, less than or equal to 0.035% of S, and the balance of Fe.

C: the higher the carbon content is and the higher the strength is, but the correspondingly reduced the plasticity and the toughness are; on the contrary, the lower the carbon content is and the higher the plasticity and the toughness are, but the correspondingly reduced the strength is. In order to achieve matched strength and toughness of the excavator bucket, carbon accounts for 0.1% to 0.6% by weight of the cast steel of the present invention. Carbon is present in steel mainly in a form of a solid solution or generating carbides. The carbides may serve as reinforcing phases to enhance the hardness and the strength of steel, carbide grains are very fine and uniformly distributed by using a heat treatment method, to be specific, melting all the carbides in austenite at a relatively high temperature and then carrying out heat treatment by using a carbide micronized quenching manner, and therefore, the toughness of steel may be further improved.

Si is used for preventing oxidization of steel, stabilising a matrix, ensuring the strength of the excavator, restricting generation of proeutectoid ferrite and promoting formation of acicular ferrite. However, Si will be likely to generate low-melting-point silicate to increase the mobility of slag and fusions, thus resulting in sputtering to affect the quality of the excavator bucket, and when the Si content exceeds a certain value, the impact toughness of ferrite will drop sharply.

Mn is one of strengthening elements and can be dissolved in ferrite to play a solid solution strengthening role, improve the hardenability of alloys and enhance the wear resistance and the strength of the excavator bucket. Mn also serves as a favorable deoxidising agent and a favorable desulfurizing agent and may be used to perform deoxidization and desulfurization, such that, when the Mn content is 0.5% to 1.8%, the strength of the excavator bucket is significantly improved and the impact toughness of Mn at a low temperature can be improved.

Cr (chromium) is capable of restricting and reducing separation-out of proeutectoid ferrite and refining grains of ferrite, and facilitates to increase the content of acicular ferrite, improve the strength, the hardness and the wear resistance significantly while reducing the plasticity and the toughness, and improve the brittle transition temperature and the temper brittleness of steel. The hardness and the strength of steel can be improved by adding a certain amount of Cr, and with the increase of Cr content, the tensile strength and the hardness of steel may also rise significantly, and Cr accounts for 0.5% to 1.6% by weight of the cast steel of the present invention.

Ni is capable of strengthening ferrite and improving the toughness and the strength, more particularly low temperature impact toughness, of cast steel, improving the resistance of steel to fatigue and reducing the sensitivity of steel to gaps, reducing the ductile-brittle transition temperature, enhancing the yield ratio, improving the machinability and the weldability of steel, and resisting corrosion from alkali and atmosphere. However, Ni belongs to scarce strategic supplies, and is relatively expensive in price. Ni accounts for 0.2% to 0.75% by weight in the present invention.

Mo (molybdenum) has the characteristics of good high-temperature strength, high hardness, large density, high resistance to corrosion, small coefficient of thermal expansion, favorable conductivity to electricity and heat, and the like. Mo is very hard. Steel may become hardened after adding a little amount of Mo to steel.

P and S will reduce the plasticity, the cost will be increased when the contents of P and S are controlled to be excessively low, and the problems in steel are not always caused by inclusions.

The method for casting the integral excavator bucket from the cast steel is characterized by comprising the following steps:

1) putting cast steel components into a melting furnace and melting at 1600-1650° C., such that a charging material is molten stably and uniformly to reach a casting requirement;

2) carrying out modification treatment before furnace on molten steel: adding rare earth to the melting furnace before casting and carrying out modification treatment on molten steel at 1600-1620° C., and then putting a grain refiner to further modify the molten steel to obtain modified molten steel;

3) manufacturing models and a template: manufacturing the bottom plate provided with an aspirating chamber, and an upper model and a lower model consistent with the excavator bucket, wherein air vents are formed in edges, dead angles, internal corners and deep grooves of the upper model and the lower model, the models are fixed on the bottom plate, and the air vents are directly communicated with the aspirating chamber of the bottom plate; the aspirating chamber of the bottom plate has a function of aspirating air from the models, such that the models are at a negative pressure state; and the models are made of aluminum plates or boards;

4) coating, heating and vacuumizing: heating an EVA plastic film having a size equal to that of the models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 to 9 Kpa to form an upper box cavity; and putting the other sandbox equipped with a filtering and aspirating system onto the lower model coated in the step 4), and repeatedly operating said step to form a lower box cavity;

6) performing mold closing and casting: closing the upper box cavity and the lower box cavity in the step 5), placing a casting head, pouring the molten steel subjected to modification treatment in the step 2) into a cavity formed after the upper box cavity and the lower box cavity are closed and then casting, continuously vacuumizing for 2 to 2.5 h at a negative pressure of 4 to 9 Kpa after casting is finished, releasing the negative pressure and hoisting the sandboxes, and breaking up the quartz sand to obtain a molded piece.

7) heating the molded piece in the step 6) in a heat treatment furnace to 890 to 910° C., preserving heat for 2.5 to 3 h and then quenching;

8) tempering the quenched molded piece, and naturally cooling the molded piece to room temperature after tempering is finished to obtain a tempered molded piece; and thus finishing casting of the excavator bucket.

Preferably, the melting temperature in step 1) is 1600 to 1650° C.; the molten steel casting temperature in step 6) is 1580 to 1660° C.; and the tempering conditions in the step 8) are: the tempering temperature is 540 to 560° C., and the heat preservation time is 3 to 4 h.

Preferably, the amount of rare earth added in the step 2) is 0.2% to 0.4% by weight of the molten steel, the rare earth element is lanthanum or cerium or yttrium or combinations thereof, and the modified molten steel stands for 10 to 15 minutes.

Rare earth (Re): as rare-earth elements interact with other elements in grain boundary segregation to cause variations of a grain boundary in structure, chemical components and energy and affect diffusion of other elements as well as nucleation and growth of a new phase, steel varies in tissue performance, and meanwhile has deoxidization and desulfurization performances, as well as improved lateral performance and low-temperature toughness.

Re may interact with low-melting-point harmful elements, such as P, As, Sn, Sb, Bi and Pb, not only is capable of forming compounds having relatively high melting points with these impurities, but also restricting segregation of these inclusions on grain boundaries to play a purifying role, such that impurities in steel are reduced. Rare earth is very likely to generate rare-earth oxysulfides and rare-earth sulfide to form compound inclusions or rare-earth silicate compounds which are high in melting point and very stable and may control the morphologies of inclusions. Rare earth is capable of absorbing a large amount of hydrogen and may restrict brittleness and white spots caused by hydrogen in steel. Rare earth may improve the strength and the toughness, reduce the brittle transition temperature and improve the endurance strength of steel, more particularly lateral impact toughness, and is conductive to improving the fatigue property of steel.

As described in the method of the present invention, molten steel stands after rare earth elements are added, to ensure that rare earth is sufficiently fused with elements in the molten steel and develop the functions of rare earth to refine grains and control morphologies of inclusions.

The amount of the grain refiner added in the step 2) is 0.05% to 0.2% by weight of the molten steel, and the grain refiner is added to the molten steel under the protection of a protecting gas, wherein the grain refiner is TiN or $YNi_2Si_2$ or CeS or MnSi or TiaOb or BN or CrN or TiC or NbC or $CeCo_4B$ or combinations thereof, and the grain refiner has a granularity of 10 to 500 nm, and the average grain size is 30 to 100 nm.

The protecting gas is argon or helium, such that the grain refiner is dispersed in a molten steel matrix very finely to effectively improve the effect of the grain refiner, and molten steel is protected away from the pollution from air.

The grain refiner: TiN grains have a good coherent relation with austenite and are capable of refining austenite grains intensively and improving the toughness of metals greatly. As nano-scale TIN is added to the formula as a modifier, and the nano-scale modifier is a special additive which takes a nanomaterial having a very fine dispersion size and huge surface energy as a main body, is capable of not only increasing crystallization nuclei as well as significantly refining grains and changing matrix tissue structures, but also forming uniformly distributed hard points in tissues and impeding slip and wear of crystals. Therefore, the nano-scale modifier is capable of improving the strength, the hardness, the hardenability and the toughness of steel and iron materials significantly, nano-scale TiN has the functions mainly residing in that: 1), refined crystal strengthening: the nano-scale modifier is added to molten steel, and TiN hard nanoparticles therein may become nuclei directly such that the quantity of formed crystals and the sizes of refined crystals are greatly increased, and the hardness, the toughness, the resistance, the hardenability and other properties of products are improved; 2), dispersion strengthening: nano-scale TiN has a cubic lattice, high melting point, high hardness, large surface activity, high lattice matching degree and uniformly distributed grains (30-50 nm), and is capable of filling up defects in crystals and lattices spontaneously, forming uniformly distributed hard points in tissues and impeding slip and wear of crystals, thus improving the product performances; and 3), cost reduction and benefit increase: use of a part of rare precious metals may be reduced or canceled properly, such that the cost is reduced and resources are saved.

A compound additive of $YNi_2Si_2$ or CeS or MnSi or TiaOb or BN or CrN or TiC or NbC or $CeCo_4B$ is added. Y, Ce, Ti, B, Cr and Nb each greatly differs from Fe in atomic radius with the mismatch degree exceeding 15%, and thus has relatively small solid solubility in Fe; Y, Ce, Ti, B, Cr and Nb are active elements, and can reduce the free energy and facilitate to fill up the defects at eutectic Si phases and boundaries and reduce the diffusion rate of Si atoms, thus restricting growth of eutectic Si phases and accordingly refining the eutectic Si phases; and the compound additive has the functions of refining and densifying microscopic dendritic structures inside cast steel, such that macrograin tissues are refined.

According to the invention, a grain refining effect is further controlled by strictly controlling the granularity distribution of a grain refiner, the grain refiner controls the refining efficiency of grains in a formed casting by being jointly combined with cast steel components in proportions, and meanwhile, a casting process cannot be impeded.

Preferably, a casting inoculator is added to a casting process in the step 6) in two batches, and the total addition amount of the inoculator is 0.05% to 0.07% by weight of the molten steel, to be specific: adding 20% to 30% by weight of casting inoculator when ⅓ molten steel is casted, adding ⅓ molten steel in the second batch after first inoculation is performed for 1 to 2 minutes, then adding the remaining casting inoculator and performing second inoculation for 2 to 3 minutes, and finally adding the remaining molten steel, wherein the casting inoculator is conveyed in a helium atmosphere at a flow of 0.04 to 0.08 Kg/s; and the casting inoculator comprises the following components in parts by weight: 15 to 25 parts of W, 10 to 25 parts of Si, to 30 parts of B, 1 to 5 parts of Ga and 15 to 18 parts of Ba, and the casting inoculator has a grain size of 250 to 400 μm.

B is capable of purifying grain boundaries of steel and forming elements with compounds of C and N, has a dispersion strengthening effect and has the capabilities of refining tissues and improving the wear resistance;

Ba is an element having largest activity among alkaline-earth metals, has a favorable deoxidization effect, is capable of generating stable compounds with oxygen and forming an "air jacket" on the surface of molten steel, and has a significant effect in aspects of improving the wall thickness sensitivity of a casting and improving the fading resistance;

Si has an inoculation function and can be used for adjusting the toughness of alloy steel;

W has a function of stabilising crystals;

Si and Ba can be used for reducing the melting point of an inoculator, and has a better inoculation effect owing to melting point and fast instantaneous dispersion; and Ca guarantees least production of slag when Ca is added to molten iron, has a synergistic effect with Ca, Ba, Si and the like, has the capability of improving the mechanical property, and thus has favorable tensile strength and wear resistance.

A refined inoculator structure (250 to 400 μm) can be dispersed in molten iron uniformly, such that a contact area with molten steel is increased and the inoculation efficiency is improved.

Furthermore, the added inoculator also has the capability of promoting a catalysis effect of oxides of P and S in a solidification process and at a solid state in later-stage steel casting on evolution of a microstructure.

Preferably, a quenching solution composition adopted for quenching in step 7) comprises the following components in parts by weight: 30 to 70 parts of polyvinylpyrrolidone, 0.2 to 5 parts of polyvinyl alcohol, 0.2 to 6 parts of triethanolamine, 2 to 4 parts of ethylene oxide and propylene oxide random copolymer, 0.6 to 0.7 part of sodium chloride, 0.6 to 1.2 parts of potassium chloride, 0.5 to 10 parts of anti-rust agent, 0.5 to 5 parts of sterilising agent, 0.005 to 0.3 part of defoaming agent, 0.1 to 5 parts of scale inhibitor, 0.1 to 5 parts of cleaning dispersant, and 5 to 60 parts of water.

Further preferably, the molecular weight of the polyvinylpyrrolidone is 200,000 to 500,000. The molecular weight of polyvinyl alcohol is 200,000 to 400,000. The molecular weight of the ethylene oxide and propylene oxide random copolymer is 200,000 to 400,000. The anti-rust agent is selected from at least one of boric acid, borate, polybasic carboxylic acid, ammonium carboxylate or ammonium alcohol carboxylate. The sterilising agent is selected from at least one of triazine, methylenedimorpholine or dimethyl oxazolidine. The defoaming agent is selected from at least one of modified organosilicone, polyether organosilicone, macromolecular polysiloxane, nanosilicon, polyether or polyethylene glycol. The scale inhibitor is organic phosphonic acid which is hydroxyethylidene phosphonic acid, phosphoryl carboxylic acid or aminomethyl phosphoric acid. The cleaning dispersant is polyoxyethylene ether. The sterilising agent is one or more of triazines and isothiazolinones.

The aqueous quenching solution in the present invention is an environment-friendly aqueous quenching solution based on high-quality polyvinylpyrrolidone, and is compounded with balanced anti-rust additive, cleaning dispersant, foam inhibitor and the like. The aqueous quenching solution has great cooling rate in a high-temperature cooling stage, such that grains are refined and the final performances of a quenched workpiece are improved. The aqueous quenching solution has an appropriate cooling rate in a low-temperature cooling stage; the quenching solution is attached to the scorching workpiece and explodes fiercely into fog (film collapse), such that a steam film on the surface of the workpiece is damaged and the steam film stage in the quenching process is greatly shortened, and therefore the cooling rate of the workpiece is uniform; the problems, such as cracking and deformation in a cooling process of the workpiece are effectively solved, and the machining precision and the surface quality of the workpiece are improved; in addition, the quenched workpiece is effectively protected due to excellent anti-rust property to completely meet the anti-rust requirement among procedures; owing to outstanding surface cleaning performance, the quenching solution can effectively avoid formation of oxide skin, is less in output amount, low in consumption, low in toxicity and environment-friendly, and greatly improves the machining quality of a quenched surface, improve the production efficiency and save the production cost.

Preferably, during quenching, the molded piece is put into the quenching solution in a vacuum state or in an atmosphere of argon or helium, without contacting air, such that the pollutions of the workpiece from oxygen, hydrogen and the like in air are solved.

Further preferably, the temperature of the quenching solution is 20 to 50° C. and can be controlled by adopting a method of cooling with cooling water or cyclically cooling the quenching solution to ensure the quenching effect.

Preferably, in the step 7), in a process of preserving heat for 2.5 to 3 h after heating to 890 to 910° C., alcohol in a heat treatment surface combusts to form a reducing atmosphere so as to prevent the molded piece from forming oxide skin.

Preferably, in the step 7), in a process of preserving heat for 2.5 to 3 h after heating to 890 to 910° C., vacuum or argon protective heating may also be selected in the heat treatment furnace.

Preferably, said method further comprises performing heating pretreatment on the molded piece obtained in the step 6) prior to operation in the step 7), said pretreatment method comprising: putting the molded piece in a heating furnace, heating to 800 to 850° C., preserving heat for 1.5 to 2.5 h, cooling in air to room temperature after discharged out of the furnace, and then performing treatment as described in the step 7) so as to adjust the strength, the hardness and the toughness of the molded piece, refine grains, improve tissues, make preparations for final heat treatment, and improve the toughness and the wear resistance of the excavator bucket.

Preferably, in a molded piece tempering process of the step 8), the vacuum degree in the furnace is 0.025 to 0.05 MPa, methanol and NH3 are charged with methanol accounting for 60% and NH3 accounting for 40% to form a nitrocarburized compound layer which is 9-10 μm in depth. The wear resistance and the fatigue resistance on the surface of the excavator bucket are improved to ensure that the excavator bucket is not cracked and peeled off after used for a long time, and therefore the service life of the excavator bucket is prolonged.

The present invention has the beneficial effects:

1. The bottom plate, the side plates, the top plate and the lifting lug of the excavator bucket of the present invention are casted into a whole, and are connected with each other without weld seam;

2. wear-resistant plate ribs are provided on the bottom of the excavator bucket of the present invention, and wear-resistant blocks and wear-resistant semispheres are provided on the side plates and are formed by once casting, such that the wear resistance of the excavator bucket is improved:

3. the present invention adopts a vacuum sealing process ad selects appropriate low-alloy steel materials, such that the mold-filling capacity and the shrinkage property of molten steel are improved, and the excavator bucket is formed by once casting without shrinkage cavity and shrinkage porosity, and is high in strength, resistant to wear and corrosion, high in impact resistance which is more than three times that of an ordinary excavator bucket and especially suitable for use in harsh conditions:

4. the comprehensive mechanical property of steel is improved by adding the grain refiner, and the wear resistance of steel to which the grain refiner is added is improved by over 30% than that to which no grain refiner is added, such that the service life is greatly prolonged:

5. the grain refiner is added to molten steel under the protection of a protecting gas in a modification treatment process to ensure stable properties of molten steel and no occurrence of a coloring phenomenon during heat treatment, and the function of the grain refiner to refine grains can be intensified;

6. a casting inoculator is added, and grains of the excavator bucket are relatively fine and uniform, such that the mechanical property and the wear resistance are greatly improved; the refined inoculator can be dispersed in molten iron uniformly, such that a contact area with molten steel is increased and the inoculation efficiency is improved, and meanwhile, the efficiency of interaction between the casting inoculator and molten steel is increased by combining negative-pressure vacuum treatment after casting is finished, and an improvement effect on the quality of molten steel is greatly enhanced, and the wear resistance of the excavator bucket is improved;

7. the molded piece prior to tempering is preheated to adjust the strength, the hardness and the toughness thereof, refine grains, improve tissues, make preparations for final heat treatment, and improve the toughness and the wear resistance of the excavator bucket;

8. the quenching solution composition of the present invention sufficiently uses synergistic effects of the polyvinylpyrrolidone and the triethanolamine, the anti-rust agent, the sterilising agent, the defoaming agent, the scale inhibitor and the cleaning dispersant. The quenching solution composition has fast cooling rate in a high temperature area, and has a cooling rate like the cooling property of quenching oil in a low temperature area, thus effectively reducing the risks of deformation and cracking during quenching of a workpiece and improving the surface quality of the workpiece without deformation or cracking phenomenon; the workpiece has better surface quality, and the indexes, such as hardness, layer depth and metallographic structure of the workpiece satisfy requirements; and meanwhile, the quenching solution composition has the advantages of good foam resistance, no toxicity and no soot, safety and environment-friendliness and no need of cleaning, and besides, the quenching solution also has favorable inverse solubility, and in a quenching process, functional substances separated out from the quenching solution in a steam film stage and a boiling stage can fast dissolved back to the quenching solution, such that the variation of effective components in a quenching coolant is much smaller than that of similar products even the quenching coolant is used for a long time;

9. the present invention provides an integrally cast excavator bucket which is simple in structure, long in service and capable of avoiding miscellaneous welding procedures; and 10. according to the process adopted in the present invention, molding sand can be repeatedly used, such that the production cost is reduced.

DETAILED DESCRIPTION

Figure 1:
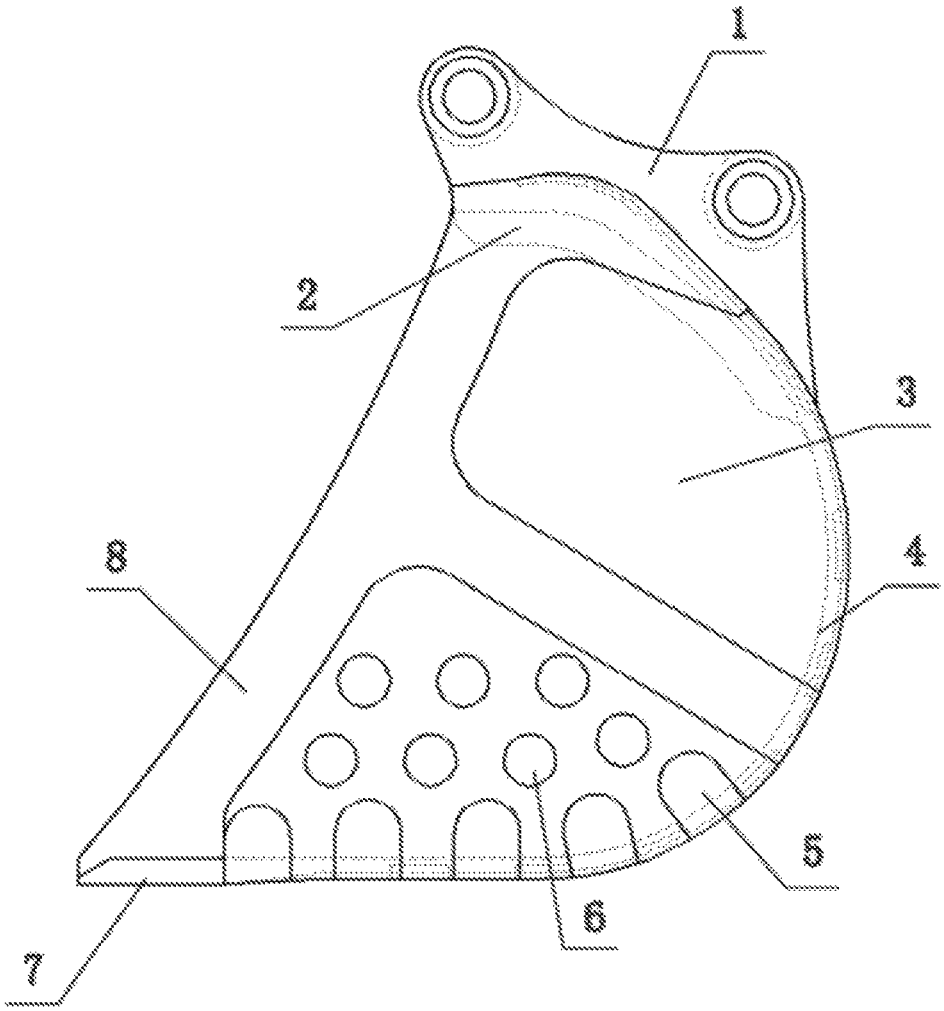
FIG. 1 is a structural schematic diagram of the excavator bucket of the present invention.
Figure 2:
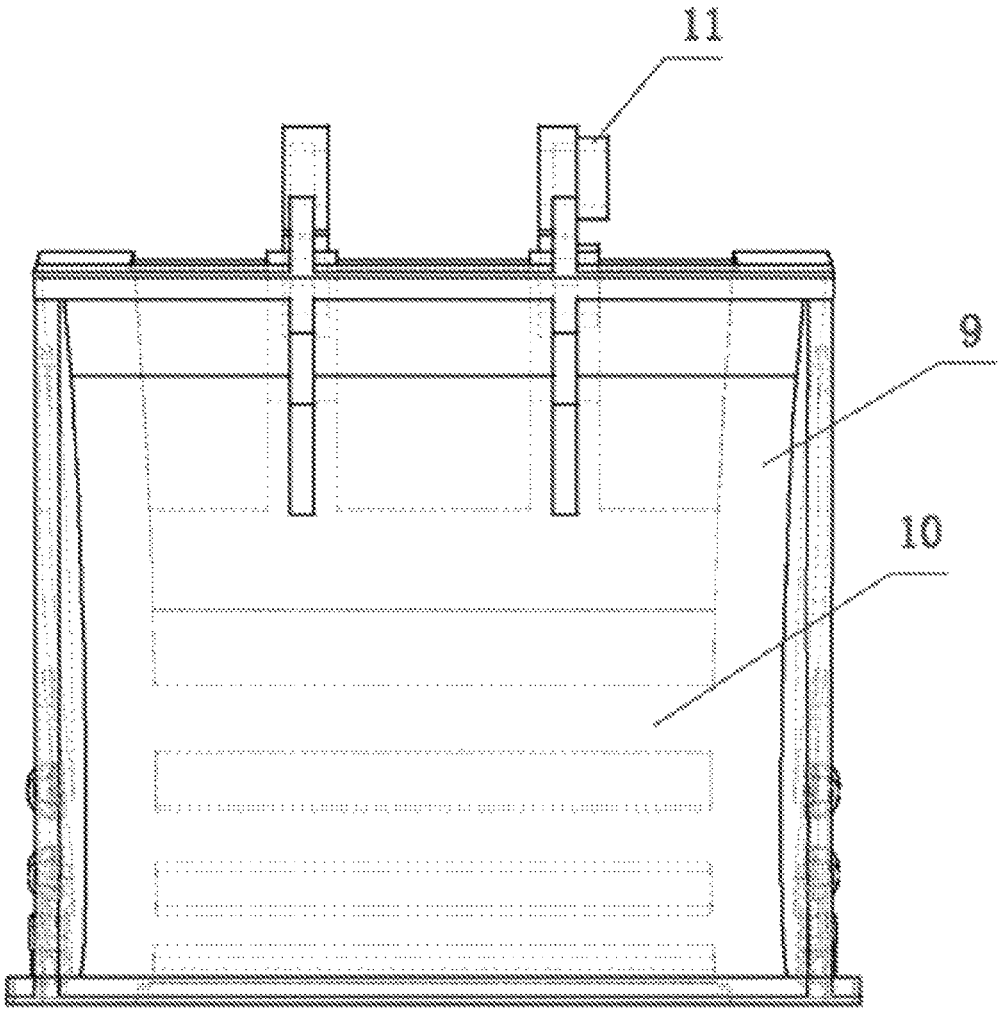
FIG. 2 is a structural schematic diagram of the excavator bucket of the present invention; wherein lifting lug 1, lifting lug reinforcing rib 2, side plate 3, bottom plate 4, wear-resistant block 5, wear-resistant sphere 6, front edge 7 of bucket, side toothed plate 8, longitudinal rib 9, and transverse rib 10 are marked.

The present invention will be further illustrated below in combination with the following embodiments, however, the protection scope of the present invention is not limited to the scope described in embodiments.

Embodiment 1

An integrally cast excavator bucket, comprising a lifting lug (1), a top plate, two side plates (3) and a bottom plate (4) connected with the two side plates (3), wherein the lifting lug (1), the top plate, the two side plates (3) and the bottom plate (4) are of an integral structure.

A side toothed plate (8) is provided on the side plate (3), and a lifting lug reinforcing rib (2) is provided at a position where the lifting lug (1) is connected with the top plate.

A plurality of wear-resistant blocks (5) and wear-resistant spheres (6) are provided in an area, close to a front edge (7) of the bucket, of the side plate (3), and the wear-resistant blocks (5) are close to a position where the side plate (3) is connected with the bottom plate (4);

and two longitudinal ribs (9) are provided at positions, close to the two side plates (3), of the bottom plate (4), and a plurality of transverse ribs (10) are provided in the middle of the bottom plate (4).

The integrally cast excavator bucket which is of an integral structure comprises a lifting lug (1), a lifting lug reinforcing rib (2), a top plate, two side plates (3), a bottom plate (4), wear-resistant blocks (5), wear-resistant spheres (6), longitudinal ribs (9) and transverse ribs (10).

Embodiment 2

Cast steel for casting the excavator bucket consists of the following components: 0.1% to 0.6% of C, 0.2% to 0.6% of Si, 0.5% to 1.8% of Mn, 0.5% to 1.6% of Cr, 0.2% to 0.75% of Ni, 0.1% to 0.6% of Mo, less than or equal to 0.035% of P, less than or equal to 0.035% of S, and the balance of Fe.

Embodiment 3

Cast steel for casting the excavator bucket consists of the following components: 0.3% of C, 0.3% of Si, 1.8% of Mn, 1.6% of Cr, 0.55% of Ni, 0.3% of Mo, 0.025% of P, 0.015% of S, and the balance of Fe.

Embodiment 4

Cast steel for casting the excavator bucket consists of the following components: 0.25% of C, 0.4% of Si, 1.2% of Mn, 0.8% of Cr, 0.75% of Ni, 0.4% of Mo, 0.035% of P, 0.035% of S, and the balance of Fe.

Embodiment 5

Cast steel for casting the excavator bucket consists of the following components: 0.1% of C, 0.2% of Si, 0.5% of Mn, 0.5% of Cr, 0.2% of Ni, 0.1% of Mo, 0.025% of P, 0.015% of S, and the balance of Fe.

Embodiment 6

Cast steel for casting the excavator bucket consists of the following components: 0.6% of C, 0.6% of Si, 1.6% of Mn, 0.6% of Cr, 0.45% of Ni, 0.6% of Mo, 0.025% of P, 0.015% of S, and the balance of Fe.

Embodiment 7

The method for casting the integral excavator bucket from the cast steel is characterized by comprising the following steps:

1) putting cast steel components into a melting furnace and melting at 1600° C., such that a charging material is molten stably and uniformly to reach a casting requirement;

2) carrying out modification treatment before furnace on molten steel: adding rare earth to the melting furnace before casting and carrying out modification treatment on molten steel at 1600° C., and then putting a grain refiner to further modify the molten steel to obtain modified molten steel;

3) manufacturing models and a template: manufacturing the bottom plate provided with an aspirating chamber, and an upper model and a lower model consistent with the excavator bucket, wherein air vents are formed in edges, dead angles, internal corners and deep grooves of the upper model and the lower model, the models are fixed on the bottom plate, and the air vents are directly communicated with the aspirating chamber of the bottom plate; the aspirating chamber of the bottom plate has a function of aspirating air from the models, such that the models are at a negative pressure state;

4) coating, heating and vacuumizing: heating an EVA plastic film having a size equal to that of the models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 to 9 Kpa to form an upper box cavity; and putting the other sandbox equipped with a filtering and aspirating system onto the lower model coated in the step 4), and repeatedly operating said step to form a lower box cavity:

6) performing mold closing and casting: closing the upper box cavity and the lower box cavity in the step 5), placing a casting head, pouring the molten steel at 1580° C. subjected to modification treatment in the step 2) into a cavity formed after the upper box cavity and the lower box cavity are closed and then casting, continuously vacuumizing for 2 h at a negative pressure of 4 Kpa after casting is finished, releasing the negative pressure and hoisting the sandboxes, and breaking up the quartz sand to obtain a molded piece.

7) argon protective heating the molded piece in the step 6) in a heat treatment furnace to 890° C., preserving heat for 2.5 h and then quenching; and 8) tempering the quenched molded piece at 540° C. in case of preserving heat for 3 h, and naturally cooling the molded piece to room temperature after tempering is finished, and thus finishing casting of the excavator bucket.

The addition amount of rare earth in the step 2) is 0.2% by weight of molten steel, and the rare-earth element is a combination of lanthanum and yttrium according to a mass ratio of 1:2.

The amount of the grain refiner added in the step 2) is 0.05% by weight of the molten steel, and the grain refiner is added to the molten steel under the protection of a protecting gas, wherein the grain refiner is TiN, and the grain refiner has a granularity of 10 to 500 nm, and the average grain size is 80 nm.

The protecting gas is argon.

Embodiment 8

The method for manufacturing the integral excavator bucket from the cast steel is characterized by comprising the following steps:

1) putting cast steel components into a melting furnace and melting at 1650° C., such that a charging material is molten stably and uniformly to reach a casting requirement;

2) carrying out modification treatment before furnace on molten steel: adding rare earth to the melting furnace before casting and carrying out modification treatment on molten steel at 1620° C., and then putting a grain refiner to further modify the molten steel to obtain modified molten steel;

3) manufacturing models and a template: manufacturing the bottom plate provided with an aspirating chamber, and an upper model and a lower model consistent with the excavator bucket, wherein air vents are formed in major locations, such as edges, dead angles, internal corners and deep grooves of the models, the models are fixed on the bottom plate, and the air vents are directly communicated with the aspirating chamber of the bottom plate; the aspirating chamber of the bottom plate has a function of aspirating air from the models, such that the models are at a negative pressure state;

4) coating, heating and vacuumizing: heating an EVA plastic film having a size equal to that of models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 Kpa to form an upper box cavity; and putting the other sandbox equipped with a filtering and aspirating system onto the lower model coated in the step 4), and repeatedly operating said step to form a lower box cavity;

6) performing mold closing and casting: closing the upper box cavity and the lower box cavity in the step 5), placing a casting head, pouring the molten steel at 1620° C. subjected to modification treatment in the step 2) into a cavity formed after the upper box cavity and the lower box cavity are closed and then casting, continuously vacuumizing for 2.5 h at a negative pressure of 9 Kpa after casting is finished, releasing the negative pressure and hoisting the sandboxes, and breaking up the quartz sand to obtain a molded piece.

7) alcohol combusts heating the molded piece to form a reducing atmosphere in the step 6) in a heat treatment furnace to 910° C., preserving heat for 3 h and then quenching; and 8) tempering the quenched molded piece at 560° C. in case of preserving heat for 4 h, and naturally cooling the molded piece to room temperature after tempering is finished, and thus finishing casting of the excavator bucket.

The addition amount of rare earth in the step 2) is 0.4% by weight of molten steel, and the rare-earth element is a combination of lanthanum and yttrium according to a mass ratio of 1:2.

The addition amount of the grain refiner in the step 2) is 0.2% by weight of molten steel, and the grain refiner is added to the molten steel under the protection of a protecting gas, and the grain refiner is a combination of $YNi_2Si_2$, CeS and MnSi according to a mass ratio of 1:2:3 and has a granularity being 10 to 200 nm and an average grain size being 50 nm.

The protecting gas is argon.

Preferably, in a molded piece tempering process in the step 8), the vacuum degree in the furnace is 0.025 MPa, methanol and NH3 are charged with methanol accounting for 60% and NH3 accounting for 40%, to form a nitrocarburized compound layer which is 9-10 μm in depth.

A casting inoculator is added to a casting process in the step 6) in two batches, and the total addition amount of the inoculator is 0.05% by weight of the molten steel, to be specific: adding 20% by weight of casting inoculator when ⅓ molten steel is casted, adding ⅓ molten steel in the second batch after first inoculation is performed for 2 minutes, then adding the remaining casting inoculator and performing second inoculation for 3 minutes, and finally adding the remaining molten steel, wherein the casting inoculator is conveyed in a helium atmosphere at a flow of 0.08 Kg/s; and the casting inoculator comprises the following components in parts by weight: 15 parts of W, 10 parts of Si, 10 parts of B, 15 parts of Ti and 15 parts of Ba, and the casting inoculator has a grain size of 120 μm.

Embodiment 9

The method for manufacturing the integral excavator bucket from the cast steel is characterized by comprising the following steps:

1) putting cast steel components into a melting furnace and melting at 1630° C., such that a charging material is molten stably and uniformly to reach a casting requirement;

2) carrying out modification treatment before furnace on molten steel: adding rare earth to the melting furnace before casting and carrying out modification treatment on molten steel at 1610° C., and then putting a grain refiner to further modify the molten steel to obtain modified molten steel;

3) manufacturing models and a template: manufacturing the bottom plate provided with an aspirating chamber, and an upper model and a lower model consistent with the excavator bucket, wherein air vents are formed in major locations, such as edges, dead angles, internal corners and deep grooves of the models, the models are fixed on the bottom plate, and the air vents are directly communicated with the aspirating chamber of the bottom plate; the aspirating chamber of the bottom plate has a function of aspirating air from the models, such that the models are at a negative pressure state;

4) coating, heating and vacuumizing: heating an EVA plastic film having a size equal to that of models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 Kpa to form an upper box cavity; and putting the other sandbox equipped with a filtering and aspirating system onto the lower model coated in the step 4), and repeatedly operating said step to form a lower box cavity;

6) performing mold closing and casting: closing the upper box cavity and the lower box cavity in the step 5), placing a casting head, pouring the molten steel at 1590° C. subjected to modification treatment in the step 2) into a cavity formed after the upper box cavity and the lower box cavity are closed and then casting, continuously vacuumizing for 2.4 h at a negative pressure of 7 Kpa after casting is finished, releasing the negative pressure and hoisting the sandboxes, and breaking up the quartz sand to obtain a molded piece.

7) vacuum protective beating the molded piece in the step 6) in a heat treatment furnace to 900° C., preserving heat for 2.8 h and then quenching; and 8) tempering the quenched molded piece at 550° C. in case of preserving heat for 3.5 h, and naturally cooling the molded piece to room temperature after tempering is finished, and thus finishing casting of the excavator bucket.

The addition amount of rare earth in the step 2) is 0.3% by weight of molten steel, and the rare-earth element is a combination of lanthanum and cerium according to a mass ratio of 1:2.

The addition amount of the grain refiner in the step 2) is 0.15% by weight of molten steel, and the grain refiner is added to the molten steel under the protection of a protecting gas, and the grain refiner is a combination of TiN, $YNi_2Si_2$, CeS, MnSi and CrN according to a mass ratio of 1:2:3:1 and has a granularity being 10 to 100 nm and an average grain size being 50 nm.

The protecting gas is argon.

In a molded piece tempering process in the step 8), the vacuum degree in the furnace is 0.05 MPa, methanol and NH3 are charged with methanol accounting for 60% and NH3 accounting for 40%, to form a nitrocarburized compound layer which is 9-10 μm in depth.

A casting inoculator is added to a casting process in the step 6) in two batches, and the total addition amount of the inoculator is 0.07% by weight of the molten steel, to be specific: adding 20% by weight of casting inoculator when ⅓ molten steel is casted, adding ⅓ molten steel in the second batch after first inoculation is performed after 1 minute, then adding the remaining casting inoculator and performing second inoculation for 2 minutes, and finally adding the remaining molten steel, wherein the casting inoculator is conveyed in a helium atmosphere at a flow of 0.04 Kg/s; and the casting inoculator comprises the following components in parts by weight: 25 parts of W, 25 parts of Si, 30 parts of B, 20 parts of Ga and 18 parts of Ba, and the casting inoculator has a grain size of 250 to 350 μm.

Embodiment 10

The method for manufacturing the integral excavator bucket from the cast steel is characterized by comprising the following steps:

1) putting cast steel components into a melting furnace and melting at 1640° C., such that a charging material is molten stably and uniformly to reach a casting requirement;

2) carrying out modification treatment before furnace on molten steel: adding rare earth to the melting furnace before casting and carrying out modification treatment on molten steel at 1610° C., and then putting a grain refiner to further modify the molten steel to obtain modified molten steel;

3) manufacturing models and a template: manufacturing the bottom plate provided with an aspirating chamber, and an upper model and a lower model consistent with the excavator bucket, wherein air vents are formed in major locations, such as edges, dead angles, internal corners and deep grooves of the models, the models are fixed on the bottom plate, and the air vents are directly communicated with the aspirating chamber of the bottom plate; the aspirating chamber of the bottom plate has a function of aspirating air from the models, such that the models are at a negative pressure state;

4) coating, beating and vacuumizing: heating an EVA plastic film having a size equal to that of models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 Kpa to form an upper box cavity; and putting the other sandbox equipped with a filtering and aspirating system onto the lower model coated in the step 4), and repeatedly operating said step to form a lower box cavity;

6) performing mold closing and casting: closing the upper box cavity and the lower box cavity in the step 5), placing a casting head, pouring the molten steel at 1660° C. subjected to modification treatment in the step 2) into a cavity formed after the upper box cavity and the lower box cavity are closed and then casting, continuously vacuumizing for 2.3 h at a negative pressure of 6 Kpa after casting is finished, releasing the negative pressure and hoisting the sandboxes, and breaking up the quartz sand to obtain a molded piece.

7) heating the molded piece in the step 6) in a heat treatment furnace to 900° C., preserving heat for 2.8 h and then quenching; and during quenching, the molded piece is put into the quenching solution in a vacuum state or in an atmosphere of argon or helium, without contacting air, such that the pollutions of the workpiece from oxygen, hydrogen and the like in air are solved.

8) tempering the quenched molded piece at 550° C. in case of preserving heat for 3.5 h, and naturally cooling the molded piece to room temperature after tempering is finished, and thus finishing casting of the excavator bucket.

The addition amount of rare earth in the step 2) is 0.35% by weight of molten steel, and the rare-earth element is a combination of lanthanum, cerium and yttrium according to a mass ratio of 1:1:3.

The addition amount of the grain refiner in the step 2) is 0.15% by weight of molten steel, and the grain refiner is added to the molten steel under the protection of a protecting gas, and the grain refiner is a combination of YNi2Si2, TiaOb, CrN, TiC and NbC according to a mass ratio of 1:1:2:1:1 and has a granularity being 10 to 400 nm and an average grain size being 90 nm.

The protecting gas is helium.

In a molded piece tempering process in the step 8), the vacuum degree in the furnace is 0.03 MPa, methanol and NH3 are charged with methanol accounting for 600/0 and NH3 accounting for 40%, to form a nitrocarburized compound layer which is 9-10 μm in depth.

A casting inoculator is added to a casting process in the step 6) in two batches, and the total addition amount of the inoculator is 0.06% by weight of the molten steel, to be specific: adding 25% by weight of casting inoculator when ⅓ molten steel is casted, adding ⅓ molten steel in the second batch after first inoculation is performed for 1 to 2 minutes, then adding the remaining casting inoculator and performing second inoculation for 2.5 minutes, and finally adding the remaining molten steel, wherein the casting inoculator is conveyed in a helium atmosphere at a flow of 0.05 Kg/s; and the casting inoculator comprises the following components in parts by weight: 22 parts of W, 23 parts of Si, 25 parts of B, 18 parts of Ga and 17 parts of Ba, and the casting inoculator has a grain size of 250 to 300 μm.

Embodiment 11

The addition amount of the grain refiner used in the method of the present invention is 0.1% by weight of molten steel, and the grain refiner is added to molten steel under the protection of a protecting gas; and the grain refiner is a combination of TiN, CeS, MnSi, TiaOb, BN, CrN, TiC, NbC and CeCo4B according to a mass ratio of 1:1:1:4:2:3:1:2:1 and has a granularity being 10 to 200 nm and an average grain size being 60 nm.

Embodiment 12

The addition amount of the grain refiner used in the method of the present invention is 0.19% by weight of molten steel, and the grain refiner is added to molten steel under the protection of a protecting gas, and the grain refiner is a combination of TiN, CeS, MnSi, TiaOb, BN, TiC and NbC according to a mass ratio of 1:2:3:2:1:3:4 and has a granularity being 10 to 400 nm and an average grain size being 90 nm.

Embodiment 13

The addition amount of the grain refiner used in the method of the present invention is 0.18% by weight of molten steel, and the grain refiner is added to molten steel under the protection of a protecting gas; and the grain refiner is a combination of TiN, $YNi_2Si_2$, CeS, MnSi and TiaOb according to a mass ratio of 1:2:1:2:3 and has a granularity being 10 to 180 nm and an average grain size being 95 nm.

Embodiment 14

The addition amount of the grain refiner used in the method of the present invention is 0.15% by weight of molten steel, and the grain refiner is added to molten steel under the protection of a protecting gas; and the grain refiner is a combination of TiN, CeS, MnSi, CrN and CeCo4B according to a mass ratio of 1:2:1:2:1 and has a granularity being 10 to 300 nm and an average grain size being 90 nm.

Embodiment 15

The addition amount of the grain refiner used in the method of the present invention is 0.05~0.2% by weight of molten steel, and the grain refiner is added to molten steel under the protection of a protecting gas; and the grain refiner is a combination of TiN, CeS, MnSi, TiaOb, BN and $CeCo_4B$ according to a mass ratio of 1:1:1:2:1:1 and has a granularity being 30 to 200 nm and an average grain size being 80 nm.

Embodiment 16

The quenching solution composition adopted for quenching in the method of the present invention comprises the following components in parts by weight: 30 to 70 parts of polyvinylpyrrolidone, 0.2 to 5 parts of polyvinyl alcohol, 0.2 to 6 parts of triethanolamine, 2 to 4 parts of ethylene oxide and propylene oxide random copolymer, 0.6 to 0.7 part of sodium chloride, 0.6 to 1.2 part of potassium chloride, 0.5 to 10 part of anti-rust agent, 0.5 to 5 part of sterilising agent, 0.005 to 0.3 part of defoaming agent, 0.1 to 5 part of scale inhibitor, 0.1 to 5 part of cleaning dispersant, and 5 to 60 parts of water.

Embodiment 17

The quenching solution composition adopted for quenching in the method of the present invention comprises the following components in parts by weight: 30 parts of polyvinylpyrrolidone, 4.5 parts of polyvinyl alcohol, 5.5 parts of triethanolamine, 3.5 parts of ethylene oxide and propylene oxide random copolymer, 0.6 part of sodium chloride, 0.7 part of potassium chloride, 0.5 part of anti-rust agent, 0.5 part of sterilising agent, 0.005 part of defoaming agent, 0.1 part of scale inhibitor, 0.1 part of cleaning dispersant, and 5 parts of water.

The molecular weight of the polyvinylpyrrolidone is 200,000 to 500,000. The molecular weight of polyvinyl alcohol is 200,000 to 400,000. The molecular weight of the ethylene oxide and propylene oxide random copolymer is 200,000 to 400,000. The anti-rust agent is composed of 0.3 part of boric acid and 0.2 part of borate. The sterilising agent is composed of 0.3 part of triazine and 0.2 part of methylenedimorpholine. The defoaming agent is composed of 0.003 part of modified organosilicone and 0.002 part of polyether organosilicone. The scale inhibitor is hydroxyethylidene phosphonic acid. The cleaning dispersant is polyoxyethylene ether. The sterilising agent is of triazines.

Embodiment 18

The quenching solution composition adopted for quenching in the present invention comprises the following components in parts by weight: 70 parts of polyvinylpyrrolidone, 5 parts of polyvinyl alcohol, 6 parts of triethanolamine, 4 parts of ethylene oxide and propylene oxide random copolymer, 0.7 part of sodium chloride, 1.2 parts of potassium chloride, 10 parts of anti-rust agent, 5 parts of sterilising agent, 0.3 part of defoaming agent, 5 parts of scale inhibitor, 5 parts of cleaning dispersant, and 60 parts of water.

The molecular weight of the polyvinylpyrrolidone is 300,000 to 400,000. The molecular weight of polyvinyl alcohol is 200,000 to 400,000. The molecular weight of the ethylene oxide and propylene oxide random copolymer is 200,000 to 400,000. The anti-rust agent is selected from ammonium carboxylate. The sterilising agent is composed of 3 parts of methylenedimorpholine or 2 parts of dimethyl oxazolidine. The defoaming agent is composed of 0.4 part of modified organosilicone and 0.1 part of polyether organosilicone. The scale inhibitor is organic phosphonic acid which is phosphoryl carboxylic acid. The cleaning dispersant is polyoxyethylene ether. The sterilising agent is of isothiazolinones.

Embodiment 19

The quenching solution composition adopted for quenching in the present invention comprises the following components in parts by weight: 40 parts of polyvinylpyrrolidone, 4 parts of polyvinyl alcohol, 5 parts of triethanolamine, 3 parts of ethylene oxide and propylene oxide random copolymer, 0.65 part of sodium chloride, 1.1 parts of potassium chloride, 6 parts of anti-rust agent, 3 part of sterilising agent, 0.2 part of defoaming agent, 3 parts of scale inhibitor, 3 parts of cleaning dispersant, and 35 parts of water.

The molecular weight of the polyvinylpyrrolidone is 350,000 to 450,000. The molecular weight of polyvinyl alcohol is 200,000 to 400,000. The molecular weight of the ethylene oxide and propylene oxide random copolymer is 200,000 to 400,000. The anti-rust agent is composed of 2 parts of boric acid, 2 parts of borate and 2 parts of ammonium alcohol carboxylate. The sterilising agent is selected from methylenedimorpholine. The defoaming agent is selected from 0.005 part of modified organosilicone, 0.005 part of nanosilicon and 0.01 part of polyether. The scale inhibitor is phosphoryl carboxylic acid. The cleaning dispersant is polyoxyethylene ether. The sterilising agent is of isothiazolinones.

Embodiment 20

According to the method adopted in Embodiments 7-10, said method further comprises performing heating pretreatment on the molded piece obtained in the step 6) prior to operation in step 7), and said pretreatment method comprises the following steps: putting the molded piece in a heating furnace, heating to 800 to 850° C., preserving heat for 1.5 to 2.5 h, cooling to room temperature in air after discharged out of the furnace, and then performing treatment as described in step 7).

TABLE 1

Comparison of Performances A Excavator Bucket Manufactured in The Present Invention with Excavator Bucket Manufactured With Other Technologies

| Object | Yield Strength $R_p0.2$ $MP_a$ | Tensile Strength $R_m$ $MP_a$ | Elongation Percentage After Fracture A% | Hardness HRC | Molding Sand Utilization |
|---|---|---|---|---|---|
| Welded Excavator Bucket | 345 | 470-660 | 21 | ≤20 | |
| Excavator Bucket Integrally Last from sand mold | ≥650 | ≥799 | ≥12 | ≥28-30 | disposable |
| Excavator Bucket of The Present Invention | ≥720 | ≥900 | ≥12 | ≥30-35 | cyclically utilized |

As can be seen from Table 1, the excavator bucket manufactured by adopting the vacuum integral casting technology of the present invention can improve the yield strength, the tensile strength and the hardness of the excavator bucket, and molding sand for manufacturing can be repeatedly utilized.

Above-mentioned embodiments are just preferred technical solutions of the present invention, should not be deemed as to the limitation of the present invention, and in case that embodiments in the present application do not conflict with features in the embodiments, may be combined to each other arbitrarily. The protection scope of the present invention should be the protection scope of the technical solutions recorded in claims, including equivalent alternatives of technical features in the technical solutions recorded in claims. That is, equivalent alternative improvements within this scope should fall into the protection scope of the present invention.

What is claimed is:

1. An integrally cast excavator bucket, comprising a lifting lug (1), a top plate, two side plates (3) and a bottom plate (4) connected with the two side plates (3), wherein the lifting lug (1), the top plate, the two side plates (3) and the bottom plate (4) are of an integral structure, wherein, cast steel for casting the excavator bucket consists of the following components in percentage by weight:

0.1% to 0.6% of C, 0.2% to 0.6% of Si, 0.5% to 1.8% of Mn, 0.5% to 1.6% of Cr, 0.2% to 0.75% of Ni, 0.1% to 0.6% of Mo, less than or equal to 0.035% of P, less than or equal to 0.035% of S, and the balance of Fe.

2. The integrally cast excavator bucket according to claim 1, wherein, cast steel for casting the excavator bucket consists of the following components in percentage by weight:

0.25% of C, 0.3% of Si, 1.2% of Mn, 0.8% of Cr, 0.25% of Ni, 0.4% of Mo, less than or equal to 0.035% of P, less than or equal to 0.035% of S, and the balance of Fe.

3. A method for manufacturing an integrally cast excavator bucket from cast steel, wherein, said method comprises the following steps:

1) putting cast steel components into a melting furnace and melting, such that a charging material is molten stably and uniformly to reach a casting requirement;

2) carrying out modification treatment before furnace on molten steel: adding rare earth to the melting furnace before casting and carrying out modification treatment on molten steel at 1600-1620° C., and then adding a grain refiner to further modify the molten steel to obtain modified molten steel;

3) manufacturing models and a template: manufacturing a bottom plate provided with an aspirating chamber, and an upper model and a lower model consistent with the excavator bucket, wherein air vents are formed in edges, dead angles, internal corners and deep grooves of the upper model and the lower model, the models are fixed on the bottom plate, and the air vents are directly communicated with the aspirating chamber of the bottom plate;

4) coating, heating and vacuumizing: heating an EVA plastic film having a size equal to that of the models of the excavator bucket to be softened to obtain a softened film, and starting a vacuumizing device, such that the softened film is tightly clung to the upper model and the lower model in the step 3) respectively, and a cast steel coating is spray-coated and dried to obtain a coated upper model and a coated lower model;

5) placing sandboxes, adding sand and molding: putting a sandbox equipped with a filtering and aspirating system onto the upper model coated in the step 4), filling the sandbox with dry quartz sand which does not contain an adhesive and additives, starting a vibration compacting table, compacting the quartz sand in the sandbox by vibration and flattening a sand surface, then covering a layer of plastic film and sealing, opening an aspirating valve, and molding the quartz in the sandbox at a negative pressure of 4 to 9 Kpa to form an upper box cavity; and putting the other sandbox equipped with a filtering and aspirating system onto the lower model coated in the step 4), and repeatedly operating said step to form a lower box cavity:

6) performing mold closing and casting: closing the upper box cavity and the lower box cavity in the step 5), placing a casting head, pouring the molten steel subjected to modification treatment in the step 2) into a cavity formed after the upper box cavity and the lower box cavity are closed and then casting, continuously vacuumizing for 2 to 2.5 h at a negative pressure of 4 to 9 Kpa after casting is finished, stopping vacuumizing at a negative pressure and hoisting the sandboxes, and breaking up the quartz sand to obtain a molded piece;

7) heating the molded piece in the step 6) in a heat treatment furnace to 890 to 910° C., preserving heat for 2.5 to 3 h and then quenching;

8) tempering the quenched molded piece, and naturally cooling the molded piece to room temperature after tempering is finished to obtain a tempered molded piece; and thus finishing casting of the excavator bucket.

4. The method according to claim 3, wherein, the melting temperature in step 1) is 1600 to 1650° C.; the molten steel casting temperature in step 6) is 1580 to 1660° C.; and the tempering conditions in the step 8) are: the tempering temperature is 540 to 560 ° C., and the heat preservation time is 3 to 4 h.

5. The method according to claim 3, wherein, the amount of rare earth added in the step 2) is 0.2% to 0.4% by weight of the molten steel, the rare earth element is lanthanum or cerium or yttrium or combinations thereof, and the modified molten steel stands for 10 to 15 minutes.

6. The method according to claim 3, wherein, the amount of the grain refiner added in the step 2) is 0.05% to 0.2% by weight of the molten steel, and the grain refiner is added to the molten steel under the protection of a protecting gas, wherein the grain refiner is TiN or $YNi_2Si_2$ or CeS or MnSi or TiaOb or BN or CrN or TiC or NbC or $CeCo_4B$ or combinations thereof, the grain refiner has a granularity of 10 to 500 nm, and the average grain size is 30 to 100 nm.

7. The method according to claim 3, wherein, a casting inoculator is added to a casting process in the step 6) in two batches, and the total addition amount of the inoculator is 0.05% to 0.07% by weight of the molten steel, to be specific: adding 20% to 30% by weight of casting inoculator when 1/13 molten steel is casted, adding 1/3 molten steel in the second batch after first inoculation is performed for 1 to 2 minutes, then adding the remaining casting inoculator and performing second inoculation for 2 to 3 minutes, and finally adding the remaining molten steel, wherein the casting inoculator is conveyed in a helium atmosphere at a flow of 0.04 to 0.08 Kg/s; and the casting inoculator comprises the following components in parts by weight: 15 to 25 parts of W, 10 to 25 parts of Si, 10 to 30 parts of B, 1 to 5 parts of Ga and 15 to 18 parts of Ba, and the casting inoculator has a grain size of 250 to 400 μm.

8. The method according to claim 3, wherein, a quenching solution composition adopted for quenching in the step 7) comprises the following components in parts by weight: 30 to 70 parts of polyvinylpyrrolidone, 0.2 to 5 parts of polyvinyl alcohol, 0.2 to 6 parts of triethanolamine, 2 to 4 parts of ethylene oxide and propylene oxide random copolymer, 0.6 to 0.7 part of sodium chloride, 0.6 to 1.2 parts of potassium chloride, 0.5 to 10 parts of anti-rust agent, 0.5 to 5 parts of sterilizing agent, 0.005 to 0.3 part of defoaming agent, 0.1 to 5 parts of scale inhibitor, 0.1 to 5 parts of cleaning dispersant, and 5 to 60 parts of water.

9. The method according to claim 3, wherein, in a process of preserving heat for 2.5 to 3 h after heating to 890 to 910° C., alcohol combusts in the heat treatment furnace to form a reducing atmosphere so as to prevent the molded piece from forming oxide skin.

10. The method according to claim 3, wherein, said method further comprises performing heating pretreatment on the molded piece obtained in the step 6) prior to operation in the step 7), said pretreatment method comprising: putting the molded piece in a heating furnace, heating to 800 to 850° C., preserving heat for 1.5 to 2.5 h, cooling in air to room temperature after discharged out of the furnace, and then performing treatment as described in the step 7).

11. The method according to claim 3, wherein, in a molded piece tempering process in the step 8), the vacuum degree in the furnace is 0. 025 to 0.05 MPa, methanol and $NH_3$ are charged with methanol accounting for 60% and $NH_3$ accounting for 40%, to form a nitrocarburized compound layer which is 9-10 μm in depth.

* * * * *